US010543500B2

(12) United States Patent
Nilsson et al.

(10) Patent No.: US 10,543,500 B2
(45) **Date of Patent: *Jan. 28, 2020**

(54) PUMP WITH A POLYMER SPRING

(71) Applicant: SCA Hygiene Products AB, Göteborg (SE)

(72) Inventors: Hugo Nilsson, Ljungby (SE); Peter Bergman, Göteborg (SE); Håkan Lindström, Göteborg (SE)

(73) Assignee: ESSITY HYGIENE AND HEALTH AKTIEBOLAG, Göteborg (SE)

( * ) Notice: Subject to any disclaimer, the term of this patent is extended or adjusted under 35 U.S.C. 154(b) by 21 days.

This patent is subject to a terminal disclaimer.

(21) Appl. No.: 15/762,798

(22) PCT Filed: Sep. 25, 2015

(86) PCT No.: PCT/EP2015/072151

§ 371 (c)(1),
(2) Date: Mar. 23, 2018

(87) PCT Pub. No.: WO2017/050392

PCT Pub. Date: Mar. 30, 2017

(65) Prior Publication Data

US 2018/0281004 A1 Oct. 4, 2018

(51) Int. Cl.

| | |
|---|---|
| ***B05B 11/00*** | (2006.01) |
| ***A47K 5/12*** | (2006.01) |
| ***A47K 5/14*** | (2006.01) |

(52) U.S. Cl.

CPC ..... *B05B 11/3077* (2013.01); *A47K 5/1207* (2013.01); *A47K 5/1209* (2013.01);
(Continued)

(58) Field of Classification Search

CPC ..... A47K 5/1208; A47K 5/1209; B05B 11/3004; B05B 11/3028; B05B 11/3029;
(Continued)

(56) References Cited

U.S. PATENT DOCUMENTS

| | | | |
|---|---|---|---|
| 1,687,317 | A | 10/1928 | Archer |
| 2,492,058 | A | 12/1949 | O'Connor |

(Continued)

FOREIGN PATENT DOCUMENTS

| | | |
|---|---|---|
| AU | 658398 | 4/1995 |
| CA | 2117205 A1 | 9/1995 |

(Continued)

OTHER PUBLICATIONS

Russian Decision to Grant dated Jan. 23, 2019 issued in Russian patent application No. 2018114651 (9 pages) and its English-language translation thereof (8 pages).

(Continued)

*Primary Examiner* — Patrick M. Buechner
(74) *Attorney, Agent, or Firm* — Drinker Biddle & Reath LLP

(57) ABSTRACT

A fluid pump includes a plastomer spring. The spring includes a first end portion and a second end portion and a plurality of rhombus shaped spring sections, joined together in series at adjacent corners and aligned with each other in an axial direction to connect the first end portion to the second end portion. The spring sections can be compressed in the axial direction from an initial condition to a compressed condition and can subsequently expand to their initial condition.

22 Claims, 12 Drawing Sheets

(52) U.S. Cl.
CPC ..... *A47K 5/14* (2013.01); *B05B 11/0054* (2013.01); *B05B 11/3029* (2013.01); *B05B 11/3033* (2013.01); *B05B 11/3035* (2013.01); *B05B 11/3064* (2013.01); *B05B 11/00412* (2018.08)

(58) Field of Classification Search
CPC ..... B05B 11/3035; B05B 11/3064; B05B 11/3073; B05B 11/3077; B05B 11/3076
See application file for complete search history.

(56) References Cited

U.S. PATENT DOCUMENTS 2,556,994 A 6/1951 Candolini
2,654,597 A 10/1953 Barényi
2,772,817 A * 12/1956 Jauch ..... A47K 5/1209 222/207
2,821,330 A 1/1958 Meylan
2,849,159 A 8/1958 Kaufmann
3,141,580 A 7/1964 Rogers
3,190,632 A 6/1965 Barényi
3,288,332 A * 11/1966 Etter ..... A47K 5/1202 222/181.3
3,387,789 A * 6/1968 Fedit ..... B05B 11/3028 222/321.2
3,656,660 A * 4/1972 Mueller ..... B05B 11/0041 222/94
4,212,408 A 7/1980 Valenzona
4,330,071 A 5/1982 Ohlson
4,347,953 A * 9/1982 Bauer ..... B05B 1/083 222/207
4,440,323 A 4/1984 Benson
4,572,117 A 2/1986 Yoshikawa
4,598,820 A 7/1986 Murphy
4,753,423 A 6/1988 Ukai et al.
4,957,218 A * 9/1990 Ford, Jr. ..... B05B 7/0037 222/1
5,082,150 A * 1/1992 Steiner ..... B67D 1/0079 222/189.09
5,282,552 A * 2/1994 Ophardt ..... A47K 5/1204 222/181.2
5,435,195 A 7/1995 Meier
5,503,306 A * 4/1996 Knickerbocker ... B05B 11/3018 222/321.1
5,518,147 A * 5/1996 Peterson ..... B05B 11/3035 222/153.07
5,651,480 A 7/1997 Piepenstock
5,746,728 A * 5/1998 Py ..... A61F 9/0008 222/207
5,850,948 A 12/1998 Garcia et al.
5,979,711 A * 11/1999 Fuchs ..... B05B 11/0005 222/321.2
6,227,240 B1 5/2001 Wu et al.
6,505,622 B2 1/2003 Py
6,536,630 B1 * 3/2003 Chan ..... B05B 11/3008 222/207
6,718,575 B1 4/2004 Lübeck et al.
6,729,505 B2 5/2004 Ramsey et al.
6,811,298 B2 11/2004 Peñaranda et al.
6,971,553 B2 12/2005 Brennan et al.
7,867,204 B2 1/2011 Bartholomew et al.
7,984,728 B2 7/2011 Wynn, Jr.
7,987,738 B2 8/2011 Kaps et al.
8,011,901 B2 9/2011 Duncan
8,695,856 B2 4/2014 Nilsson
8,701,942 B2 4/2014 Nilsson
8,708,200 B2 4/2014 Nilsson
9,475,075 B2 10/2016 Tada
9,725,228 B2 8/2017 Py et al.
9,963,288 B2 5/2018 Py et al.
10,213,062 B2 2/2019 Nilsson et al.
2002/0139816 A1 10/2002 Powling
2003/0047571 A1 3/2003 Ramsey et al.
2003/0209567 A1 * 11/2003 Crosnier ..... B05B 1/3431 222/321.9
2006/0011663 A1 * 1/2006 Greiner-Perth ..... B05B 11/3039 222/383.1
2007/0157991 A1 7/2007 Robertson
2007/0257060 A1 * 11/2007 Young ..... B05B 11/3001 222/153.13
2008/0029556 A1 2/2008 Chen
2009/0071977 A1 3/2009 Abe
2009/0110576 A1 * 4/2009 Brouwer ..... B05B 11/3028 417/472
2009/0188994 A1 7/2009 Ray et al.
2010/0059550 A1 3/2010 Ciavarella et al.
2010/0320226 A1 12/2010 Nilsson
2010/0327019 A1 12/2010 Nilsson
2011/0036863 A1 2/2011 Nilsson
2012/0118915 A1 5/2012 Harper
2012/0308405 A1 12/2012 McNulty et al.
2013/0043279 A1 2/2013 Hagleitner
2013/0292419 A1 11/2013 Quinlan et al.
2014/0117053 A1 5/2014 Ciavarella et al.
2014/0158715 A1 6/2014 Wells
2014/0183283 A1 7/2014 Tada
2014/0197196 A1 7/2014 Tederous et al.
2014/0205473 A1 7/2014 Ciavarella et al.
2015/0136122 A1 5/2015 Stuart et al.
2018/0023431 A1 1/2018 Kubinski
2018/0263431 A1 9/2018 Nilsson et al.
2018/0289222 A1 10/2018 Nilsson et al.
2019/0076864 A1 3/2019 Nilsson et al.

FOREIGN PATENT DOCUMENTS

CA 2657542 A1 9/2009
DE 202011052296 U1 2/2012
EP 2743503 A1 6/2014
GB 191016046 A 8/1910
GB 893683 A 4/1962
GB 2109148 A 5/1983
GB 2329222 A 3/1999
IT 1132947 B 7/1986
IT MI20130336 U1 4/2015
JP 7-144159 * 6/1995 ..... B05B 11/00
JP H10-47400 A 2/1998
JP H10-72052 A 3/1998
RU 2447905 C2 4/2012
WO WO-99/49769 A1 10/1999
WO WO-2000/20294 A1 4/2000
WO WO-01/34485 A1 5/2001
WO WO-02/02423 A1 1/2002
WO WO-2003/047995 A1 6/2003
WO WO-2009/104992 A1 8/2009
WO WO-2009/104993 A1 8/2009
WO WO-2009/104994 A1 8/2009
WO WO-2009/142886 A1 11/2009
WO WO-2011/133085 A1 10/2011
WO WO-2013/22634 A2 2/2013
WO WO-2013/035119 A1 3/2013
WO WO-2013/035316 A1 3/2013
WO WO-2013/055893 A2 4/2013
WO WO-2013/103670 A1 7/2013
WO WO-2013/114520 A1 8/2013
WO WO-2013/181330 A1 12/2013
WO WO-2014/036067 A1 3/2014
WO WO-2014/126751 A2 8/2014
WO WO-2014/209288 A1 12/2014
WO WO-2015/27000 A2 2/2015
WO WO-2015/083891 A1 6/2015
WO WO 2018/1277517 * 10/2018 ..... A47K 5/12

OTHER PUBLICATIONS

Examination report No. 1 issued in Australian patent application No. 2015410208, dated Jan. 31, 2019.
European Office Action dated Feb. 6, 2019 issued in European patent application No. 15 767 554.7.
Examination report No. 1 issued in Australian patent application No. 2015410277, dated Jul. 26, 2018.

(56) References Cited

OTHER PUBLICATIONS

U.S. Appl. No. 15/762,776, Nilsson et al.
U.S. Appl. No. 15/762,827, Nilsson et al.
Internet site: Series SP BELLEVILLE Springs, available at https://www.fandisc.com/disc-springs-series-sp-belleville-spring-index.html (last visited Jul. 14, 2018).
Internet site: Dupont Hytrel polyester elastomer "Product and Properties Guide" found at http://www.engpolymer.co.kr/product/molding_guide/hytrel_product_guide.pdf (last visited Jul. 14, 2018).
European Office communication under Rule 71(3) EPC (intention to grant) dated Feb. 12, 2019 issued in European patent application No. 15 771 085.6.
Russian Office Action dated Mar. 21, 2019 issued in Russian patent application No. 2018114869 (7 pages) and its English-language translation thereof (6 pages).

* cited by examiner

PUMP WITH A POLYMER SPRING

CROSS-REFERENCE TO PRIOR APPLICATION

This application is a § 371 National Stage Application of PCT International Application No. PCT/EP2015/072151 filed Sep. 25, 2015, which is incorporated herein in its entirety.

TECHNICAL FIELD

The present disclosure relates to pumps of the type used for dispensing fluids and more particularly to a spring for use in a pump for dispensing cleaning, sterilising or skin care product, e.g. products such as soaps, gels, disinfectants, moisturizer and the like. The disclosure is specifically directed to pumps and springs that are axially compressible and that cause dispensing by an axial reduction in volume of a pump chamber.

BACKGROUND

Fluid dispensers of various types are known. In particular, for dispensing of cleaning products such as soaps, there are a wide variety of manually or automatically actuated pumps that dispense a given quantity of the product into a user's hand.

Consumer products may include a dispensing outlet as part of the package, actuated by a user pressing down the top of the package. Such packages use a dip tube extending below the level of the liquid and a piston pump that aspirates the liquid and dispenses it downwards through an outlet spout.

Commercial dispensers frequently use inverted disposable containers that can be placed in dispensing devices, affixed to walls of washrooms or the like. The pump may be integrated as part of the disposable container or may be part of the permanent dispensing device or both. Such devices are generally more robust and, as they are affixed to the wall, greater freedom is available in the direction and amount of force that is required for actuation. Such devices may also use sensors that identify the location of a user's hand and cause a unit dose of the product to be dispensed. This avoids user contact with the device and the associated cross-contamination. It also prevents incorrect operation that can lead to damage and premature ageing of the dispensing mechanism.

A characteristic of inverted dispensers is the need to prevent leakage. Since the pump outlet is located below the container, gravity will act to cause the product to escape if there is any leakage through the pump. This is particularly the case for relatively volatile products such as alcohol based solutions. Achieving leak free operation is often associated with relatively complex and expensive pumps. For the convenience of replacing empty disposable containers however, at least part of the pump is generally also disposable and must be economical to produce. There is therefore a need for a pump that is reliable and drip free, yet simple and economical to produce.

One disposable dispensing system that uses a pump to dispense a unit dose of liquid from an inverted collapsible container has been described in WO2009/104992. The pump is formed of just two elements, namely a resilient pumping chamber and a regulator, having an inner valve and an outer valve. Operation of the pump occurs by application of a lateral force to the pumping chamber, causing it to partially collapse and expel its contents through the outer valve.

Refilling of the pumping chamber occurs through the inner valve once the lateral force is removed. The filling force is provided by the inherent resilience of the wall of the pumping chamber, which must be sufficient to overcome any back-pressure due to a resistance to collapse of the container. Although the pump is extremely effective, the lateral force required to operate the pump can sometimes limit its integration into a dispenser body. Other dispensing systems use an axial force i.e. directed in alignment with the direction in which the fluid is dispensed. It would be desirable to provide a pump that could operate in this manner that could also be integrated into existing axially operating dispensers.

SUMMARY

In view of the fluid pumps of the above-mentioned types, it is desired to provide an alternative pump. The pump may be disposable and is desirably reliable and drip free when used, yet simple, hygienic and economical to produce.

The disclosure relates in particular to a pump including a plastomer spring, a pump assembly, a disposable fluid dispensing package, a method of dispensing a fluid, a mould, and a dispenser. Embodiments are set forth in the following description and in the drawings.

Thus, there is disclosed a plastomer spring for use in a fluid pump, the spring including a first end portion and a second end portion and a plurality of spring sections, joined together in series and aligned with each other in an axial direction to connect the first end portion to the second end portion, which spring sections can be compressed in the axial direction from an initial condition to a compressed condition and can subsequently expand to their initial condition. By providing a plastomer element, operable in an axial direction in this manner, a stable spring may be obtained that does not twist or otherwise distort during compression and may be easily manufactured by injection moulding in a single piece. Unlike metal springs, by the use of polymer materials, the spring may be made compatible with multiple different cleaning, sterilising or skin care fluids, without the risk of corrosion or contamination. The fluid may be soap, detergent, disinfectant, moisturizer or any other form of cleaning, sterilising or skin care product. Furthermore, recycling of the pump may be facilitated, given that other elements of the pump are also of polymer material.

The spring sections may be rhombus shaped, joined together at adjacent corners. In the present context, reference to "rhombus shaped" is not intended to limit the invention to spring sections of the precise geometrical shape having flat sides and sharp corners. The skilled person will understand that the shape is intended to denote an injection mouldable form that will allow resilient collapse, while using the material properties of the plastomer to generate a restoring force. Furthermore, since the resiliency of the structure is at least partially provided by the material at the corner regions, these may be at least partially reinforced, curved, radiused or the like in order to optimise the required spring characteristic. In one embodiment, each spring section includes four flat leaves joined together along hinge lines that are parallel to each other and perpendicular to the axial direction. In this context, flat is intended to denote planar. The resulting configuration may also be described as concertina like.

The flat leaves may be of constant thickness over their area. The thickness may be between 0.5 mm and 1.5 mm, depending on the material used and the geometrical design of the pump and the spring. For example, a thickness between 0.7 and 1.2 mm has been found to offer excellent collapse characteristics in the case of leaves having a length between hinge lines of around 7 mm. In other words, the ratio of the thickness of the leaf to its length may be around 1:10, but may range from a ratio of 1:5 to a ratio of 1:15. The skilled person will recognise that for a given material, this ratio will be of significance in determining the spring constant of the resulting spring. In one alternative, the leaves may be thicker at their midline and may be thinned or feathered towards their edges. This feathering may be advantageous from a moulding perspective, allowing easier extraction from the mould. It also serves to concentrate the majority of the spring force to the midline. Where the spring is to be located in a cylindrical housing, this is the portion of the spring that provides the majority of the restoring force.

Additionally, as a measure to allow the spring to be installed in a cylindrical housing or pump chamber, the spring sections may have curved edges. The spring may then have a generally circular configuration, as viewed in the axial direction i.e. it may define a cylindrical outline. It will be understood that the curved edges may be sized such that the spring is cylindrical in its unstressed initial condition or in its compressed condition or at an intermediate position between these two extremes, for example, in its compressed condition.

The precise configuration of the spring will depend on the characteristics required in terms of extension and spring constant. An important factor in determining the degree of extension of the spring is the initial geometry of the rhombus shapes of the spring sections. In one embodiment, the spring sections, in their initial condition, join at adjacent corners having an internal angle $\alpha$ of between 90 and 120 degrees. In a fully relaxed spring, angle $\alpha$ may be between 60 to 160 or 100 to 130 degrees, depending on the geometries and materials used for the spring as well as the pump body. The angle $\alpha$ is normally slightly higher when the spring is inserted into the pump chamber and in its initial stage before pump compression occurs, e.g. 5-10 degrees higher than for a fully relaxed spring. For a spring in its compressed condition, the angle $\alpha$ increases towards 180 degrees and for example may be 160 to 180 degrees in a compressed condition. For example, the angle $\alpha$ may be 120 degrees for a spring in an initial condition and 160 degrees for a spring in a compressed condition.

A particularly desirable characteristic of the disclosed spring is its ability to undergo a significant reduction in length. In certain embodiments, the spring sections are arranged to compress from an open configuration to a substantially flat configuration in which the spring sections or the leaves lie close against each other i.e. adjacent sides of the rhombus shaped spring sections become co-planar.

In a particular embodiment, each spring section may be able to compress axially to less than 60%, or less than 50% of its uncompressed length. The overall reduction in length will depend on the number of spring sections and in actual operation, there may be neither need nor desire to compress each spring section to the maximum. In a particular embodiment, the spring may include at least three spring sections which may be identical in geometry. In an embodiment, there are five spring sections, which offers a good compromise between stability and range of compression.

The skilled person will be aware of various polymer materials that could provide the desired elastic properties required to achieve compression and recovery without excessive hysteresis losses. Thermoplastic polymers that can function like elastomers are generally referred to as plastomers. In the present context, reference to plastomer material is intended to include all thermoplastic elastomers that are elastic at ambient temperature and become plastically deformable at elevated temperatures, such that they can be processed as a melt and be extruded or injection moulded.

The disclosure is primarily directed to the configuration of the spring. Nevertheless, because a plastomer spring can be formed by injection moulding and according to a particularly significant aspect, the spring may be integrally formed with additional elements, e.g. those required for its function as part of a fluid pump. In particular, the first and second end portions may be formed to interact with other components of the pump to maintain the spring in position. In one embodiment, they may form cylindrical or part-cylindrical plugs. The first and second end portions may also be formed with passages or channels to allow fluid to flow along the spring past or through these respective portions.

In one embodiment, the spring may further include an integrally formed first valve element. The first valve element may be a circumferential element formed around the first end portion, projecting outwardly and may be formed as one of a circumferential skirt or truncated cone extending towards the second end portion, and a planar disk. The circumferential element may have a diameter that extends beyond the width of the spring sections and may be part spherical.

The spring may further include an integrally formed second valve element including a circumferential element formed on the second end portion, projecting outwardly and may be formed as one of a planar disk, and a circumferential skirt or truncated cone extending from the second end portion. The second valve element may surround the second end portion or extend axially beyond the second end portion. In one embodiment, the second valve element may be conical or frusto-conical, widening in a direction away from the first end portion. The integration of one or more valve elements with the spring, reduces the number of components that must be manufactured and also simplifies the assembly operations. Given that these components are of the same type of material, their disposal may also be a single operation.

The fluid pump may include a pump body having an elongate pump chamber surrounding the spring and extending from a pump inlet adjacent to the first end portion to a pump outlet adjacent to the second end portion. As indicated above, the pump chamber may be cylindrical and the spring may also have an exterior profile that is cylindrical in order to match and fit the pump chamber. The spring may have an external cross-sectional shape that corresponds to an internal cross-section of the pump chamber. In one embodiment, the pump chamber is cylindrical and the spring may also define a generally cylindrical envelope in this region.

As indicated above, the material for the pump body and/or the spring may be a plastomer. A plastomer may be defined by its properties, such as the Shore hardness, the brittleness temperature and Vicat softening temperature, the flexural modulus, the ultimate tensile strength and the melt index. Depending on, for example, the type of fluid to be dispensed, and the size and geometry of the pump body or spring, the plastomer material used in the pump may be vary from a soft to a hard material. The plastomer material forming at least the spring may thus have a shore hardness of from 50 Shore A (ISO 868, measured at 23 degrees C.) to 70 Shore D (ISO 868, measured at 23 degrees C.). Optimal results may be obtained using a plastomer material having a shore A hardness of 70-95 or a shore D hardness of 20-50, e.g. a shore A hardness of 75-90. Furthermore, the plastomer material may have brittleness temperature (ASTM D476)

being lower than −50 degrees Celsius, e.g. from −90 to −60 degrees C., and a Vicat softening temperature (ISO 306/SA) of 30-90 degrees Celsius, e.g. 40-80 degrees C. The plastomers may additionally have a flexural modulus in the range of 15-80 MPa, 20-40 MPa, 30-50 MPa, or 25-30 MPa (ASTM D-790), e.g. 26-28 MPa. Likewise, the plastomers may have an ultimate tensile strength in the range of 3-11 MPa, or 5-8 MPa (ASTM D-638). Additionally, the melt flow index may be at least 10 dg/min, or in the range of 20-50 dg/min (ISO standard 1133-1, measured at 190 degrees C.).

Suitable plastomers include natural and/or synthetic polymers. Particularly suitable plastomers include styrenic block copolymers, polyolefins, elastomeric alloys, thermoplastic polyurethanes, thermoplastic copolyesters and thermoplastic polyamides. In the case of polyolefins, the polyolefin can be used as a blend of at least two distinct polyolefins and/or as a co-polymer of at least two distinct monomers. In one embodiment, plastomers from the group of thermoplastic polyolefin blends are used, for example, from the group of polyolefin co-polymers. A particular group of plastomers is the group of ethylene alpha olefin copolymers. Amongst these, ethylene 1-octene copolymers have been shown to be particularly suitable, especially those having the properties as defined above. Suitable plastomers are available from ExxonMobil Chemical Co. as well as Dow Chemical Co.

It will be understood that the spring may be incorporated into the pump in a number of different ways to assist in the pumping action. In a particular embodiment, the pump chamber may be compressible together with the spring in the axial direction. This may be achieved by providing the pump chamber with a flexible wall that distorts during compression of the pump chamber. In one embodiment, the flexible wall may invert or roll-up as the spring compresses. The overall spring constant of the pump will then be the combined effect of the spring and the pump chamber. The spring may provide support to the pump chamber during its distortion. In this context, support is intended to denote that it prevents the pump chamber from distorting uncontrollably to a position in which it might not be able to restore itself. It may also assist in controlling the distortion to ensure a more constant recovery during the return stroke. It is noted that the pump body or the pump chamber may also provide support to the spring in order to allow it to compress axially in the desired manner.

In order for the spring and pump body to operate effectively together, the first and second end portions may engage with the pump inlet and pump outlet respectively, to retain such engagement during compression of the pump chamber. To this effect, the end portions may be in the form of plugs as described above that closely fit into cylindrical recesses in the inlet and outlet respectively, while allowing passages for fluid to pass by.

According to one embodiment, the spring and the pump body may be injection moulded of the same material. This is especially advantageous from the perspective of recycling and reduces the material streams during manufacture.

Still more advantageously, because of the efficient design discussed above, the whole construction of the fluid pump may be achieved using just two components, namely the pump body and the spring, whereby the pump body and the spring interact to define a one-way inlet valve and a one-way outlet valve. As will be further discussed below, the first valve element may engage against a wall of the pump inlet while the second valve element may engage against a wall of the pump outlet.

Various manufacturing procedures may be used to form the pump including blow moulding, thermoforming, 3D-printing and other methods. Some or all of the elements forming the pump may be manufactured by injection moulding. In a particular embodiment, the pump body and the spring may each be formed by injection moulding. They may both be of the same material or each may be optimised independently using different materials. As discussed above, the material may be optimised for its plastomer qualities and also for its suitability for injection moulding. Additionally, although in one embodiment, the spring is manufactured of a single material, it is not excluded that it may be manufactured of multiple materials.

In the case that the spring is integrally formed to include inlet and outlet valves, the designer is faced with two conflicting requirements, to a large degree depending on the fluid that will be pumped:

1. The valves shall be flexible enough to allow for a good seal;

2. The spring shall be stiff enough to provide the required spring constant to pump the fluid.

The disclosure further relates to a pump assembly including the pump assembly including a pump as described above, and a pair of sleeves, arranged to slidably interact to guide the pump during a pumping stroke, including a stationary sleeve engaged with the pump inlet and a sliding sleeve engaged with the pump outlet. The stationary sleeve and sliding sleeve may have mutually interacting detent surfaces that prevent their separation and define the pumping stroke. Furthermore, the stationary sleeve may include a socket having an axially extending male portion and the pump inlet has an outer diameter, dimensioned to engage within the socket and includes a boot portion, rolled over on itself to receive the male portion.

Moreover, the disclosure relates to a disposable fluid dispensing package, including a pump as described above or a pump assembly as earlier described, sealingly connected to a collapsible product container.

The disclosure also relates to a method of dispensing a fluid from a fluid pump as described above or hereinafter by exerting an axial force on the pump body between the pump inlet and the pump outlet to cause axial compression of the spring and a reduction in volume of the pump chamber.

BRIEF DESCRIPTION OF THE DRAWINGS

The features and advantages of the present disclosure will be appreciated upon reference to the following drawings of a number of exemplary embodiments, in which.

DESCRIPTION OF ILLUSTRATIVE EMBODIMENTS

Figure 1:
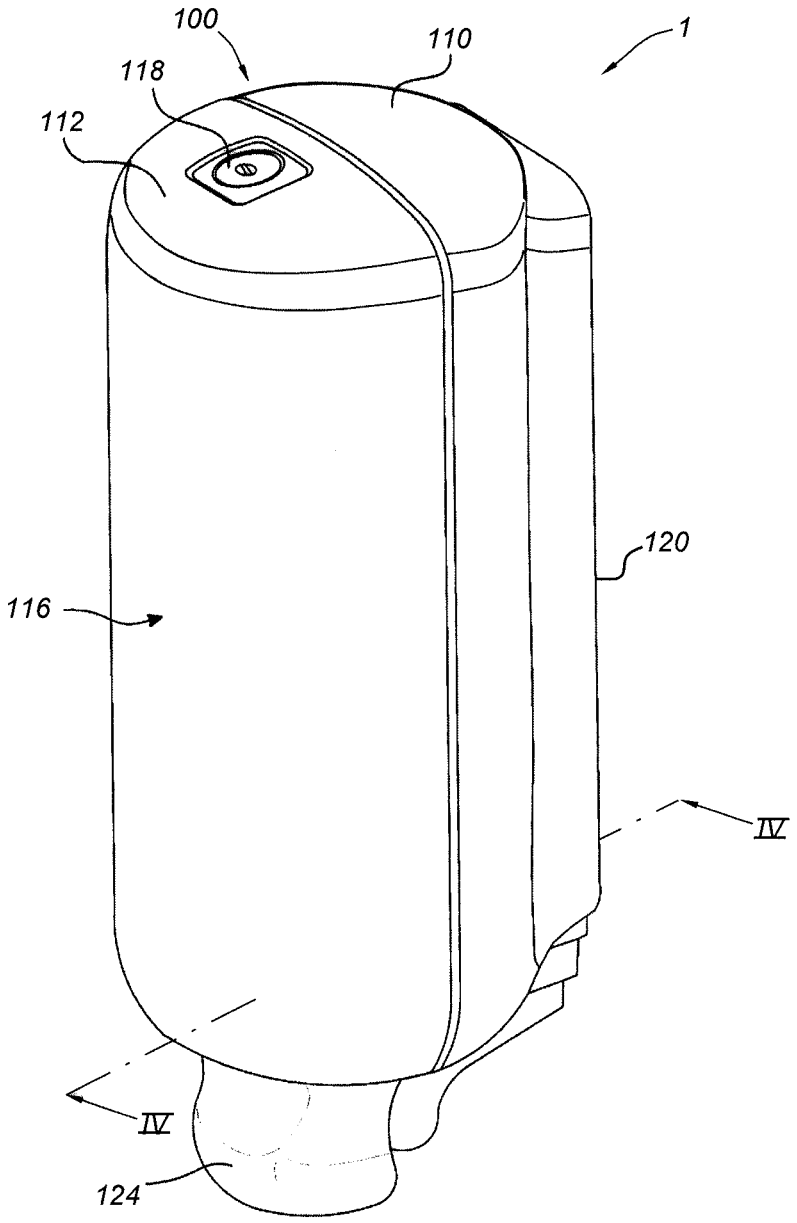
FIG. 1 shows a perspective view of a dispensing system.

FIG. 1 shows a perspective view of a dispensing system 1. The dispensing system 1 includes a reusable dispenser 100 of the type used in washrooms and the like and available under the name Tork™ from ESSITY HYGIENE AND HEALTH AKTIEBOLAG. The dispenser 100 is described in greater detail in WO2011/133085, the contents of which are incorporated herein by reference in their entirety. It will be understood that this embodiment is merely exemplary and that the present invention may also be implemented in other dispensing systems.

The dispenser 100 includes a rear shell 110 and a front shell 112 that engage together to form a closed housing 116 that can be secured using a lock 118. The housing 116 is affixed to a wall or other surface by a bracket portion 120. At a lower side of the housing 116 is an actuator 124, by which the dispensing system 1 may be manually operated to dispense a dose of cleaning fluid or the like. The operation, as will be further described below, is described in the context of a manual actuator but the invention is equally applicable to automatic actuation e.g. using a motor and sensor.

Figure 2:
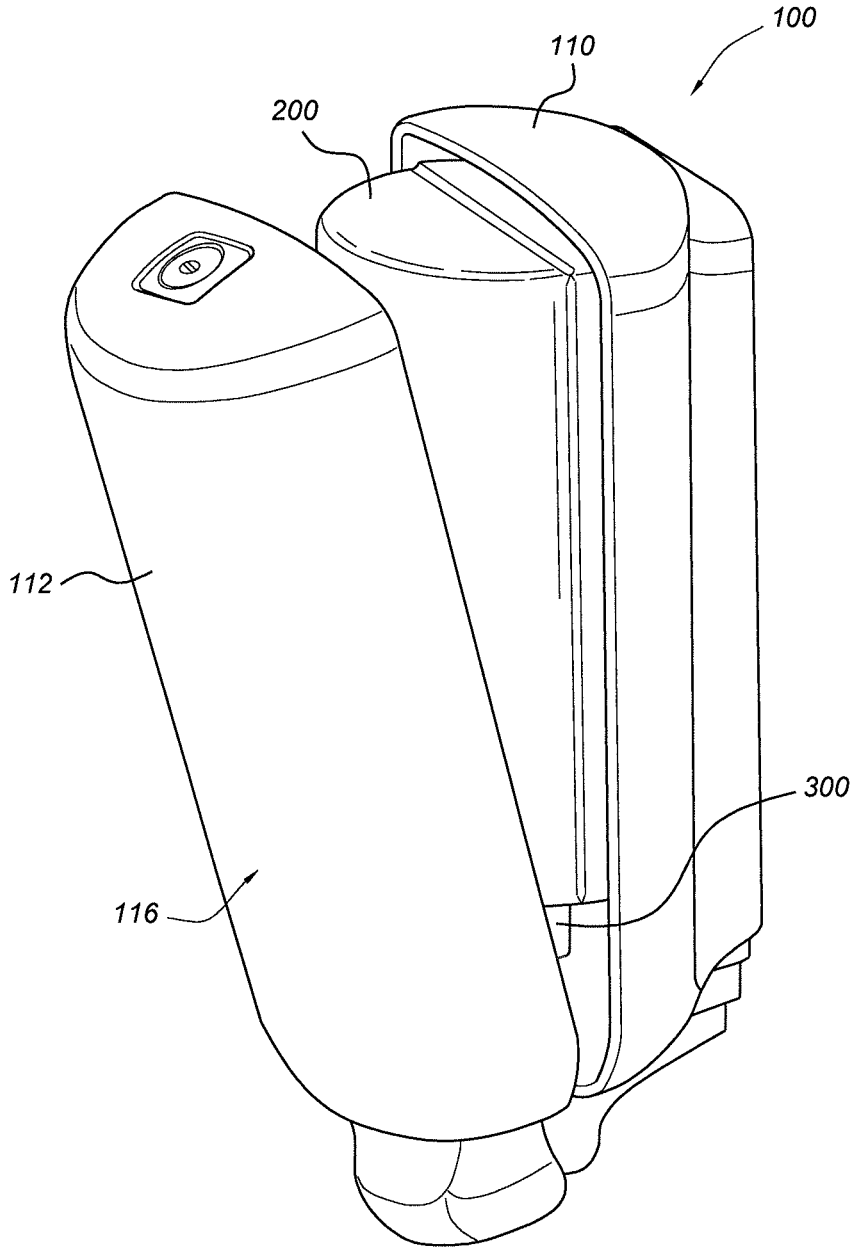
FIG. 2 shows the dispensing system of FIG. 1 in an open configuration.

FIG. 2 shows in perspective view the dispenser 100 with the housing 116 in the open configuration and with a disposable container 200 and pump assembly 300 contained therein. The container 200 is a 1000 ml collapsible container of the type described in WO2011/133085 and also in WO2009/104992, the contents of which are also incorporated herein by reference in their entirety. The container 200 is of generally cylindrical form and is made of polyethylene. The skilled person will understand that other volumes, shapes and materials are equally applicable and that the container 200 may be adapted according to the shape of the dispenser 100 and according to the fluid to be dispensed.

The pump assembly 300 has an outer configuration that corresponds substantially to that described in WO2011/133085. This allows the pump assembly 300 to be used interchangeably with existing dispensers 100. Nevertheless, the interior configuration of the pump assembly 300 is distinct from both the pump of WO2011/133085 and that of WO2009/104992, as will be further described below.

Figure 3:
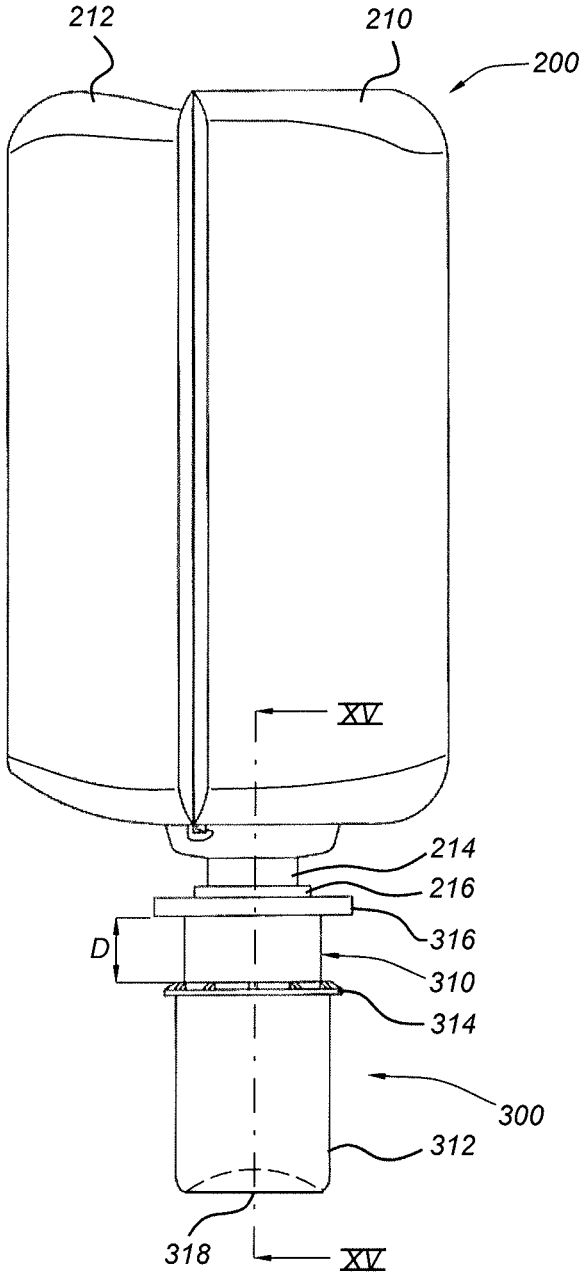
FIG. 3 shows a disposable container and pump assembly in side view.

FIG. 3, shows the disposable container 200 and pump assembly 300 in side view. As can be seen, the container 200 includes two portions, namely a hard, rear portion 210 and a soft, front portion 212. Both portions 210, 212 are made of the same material but having different thicknesses. As the container 200 empties, the front portion 210 collapses into the rear portion as liquid is dispensed by the pump assembly 300. This construction avoids the problem with a build-up of vacuum within the container 200. The skilled person will understand that although this is an example of a form of container, other types of reservoir may also be used in the context of the present disclosure, including but not limited to bags, pouches, cylinders and the like, both closed and opened to the atmosphere. The container may be filled with soap, detergent, disinfectant, skin-care liquid, moisturizers or any other appropriate fluid and even medicaments. In most cases, the fluid will be aqueous although the skilled person will understand that other substances may be used where appropriate, including oils, solvents, alcohols and the like. Furthermore, although reference will be made in the following to liquids, the dispenser 1 may also dispense fluids such as dispersions, suspensions or particulates.

At the lower side of the container 200, there is provided a rigid neck 214 provided with a connecting flange 216. The connecting flange 216 engages with a stationary sleeve 310 of the pump assembly 300. The pump assembly 300 also includes a sliding sleeve 312, which terminates at an orifice 318. The sliding sleeve 312 carries an actuating flange 314 and the stationary sleeve has a locating flange 316. Both the sleeves 310, 312 are injection moulded of polycarbonate although the skilled person will be well aware that other relatively rigid, mouldable materials may be used. In use, as will be described in further detail below, the sliding sleeve 312 is displaceable by a distance D with respect to the stationary sleeve 310 in order to perform a single pumping action.

Figure 4A:
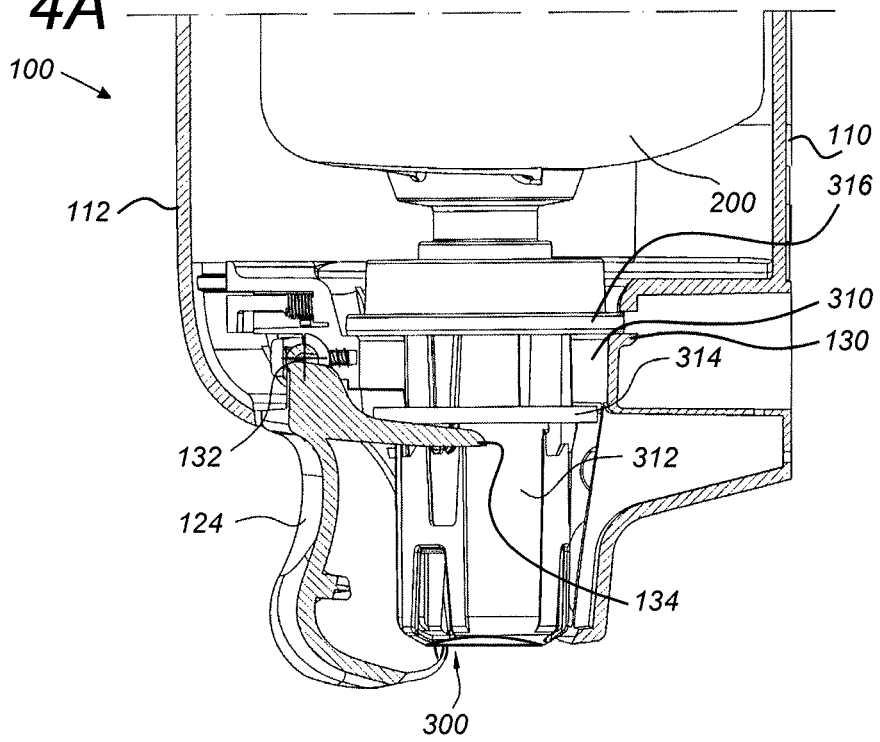
FIGS. 4A and 4B show partial cross-sectional views of the pump of FIG. 1 in operation.
Figure 4B:
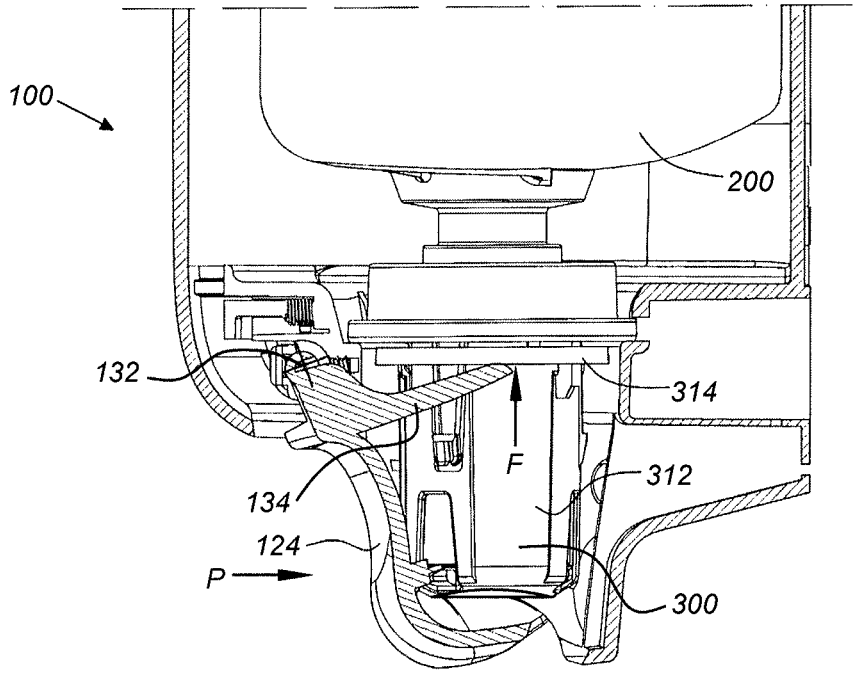

FIGS. 4A and 4B show partial cross-sectional views through the dispenser 100 of FIG. 1, illustrating the pump assembly 300 in operation. According to FIG. 4A, the locating flange 316 is engaged by a locating groove 130 on the rear shell 110. The actuator 124 is pivoted at pivot 132 to the front shell 112 and includes an engagement portion 134 that engages beneath the actuating flange 314.

FIG. 4B shows the position of the pump assembly 300 once a user has exerted a force P on actuator 124. In this view, the actuator 124 has rotated anti-clockwise about the pivot 132, causing the engagement portion 134 to act against the actuating flange 314 with a force F, causing it to move upwards. Thus far, the dispensing system 1 and its operation is essentially the same as that of the existing system known from WO2011/133085.

Figure 5:
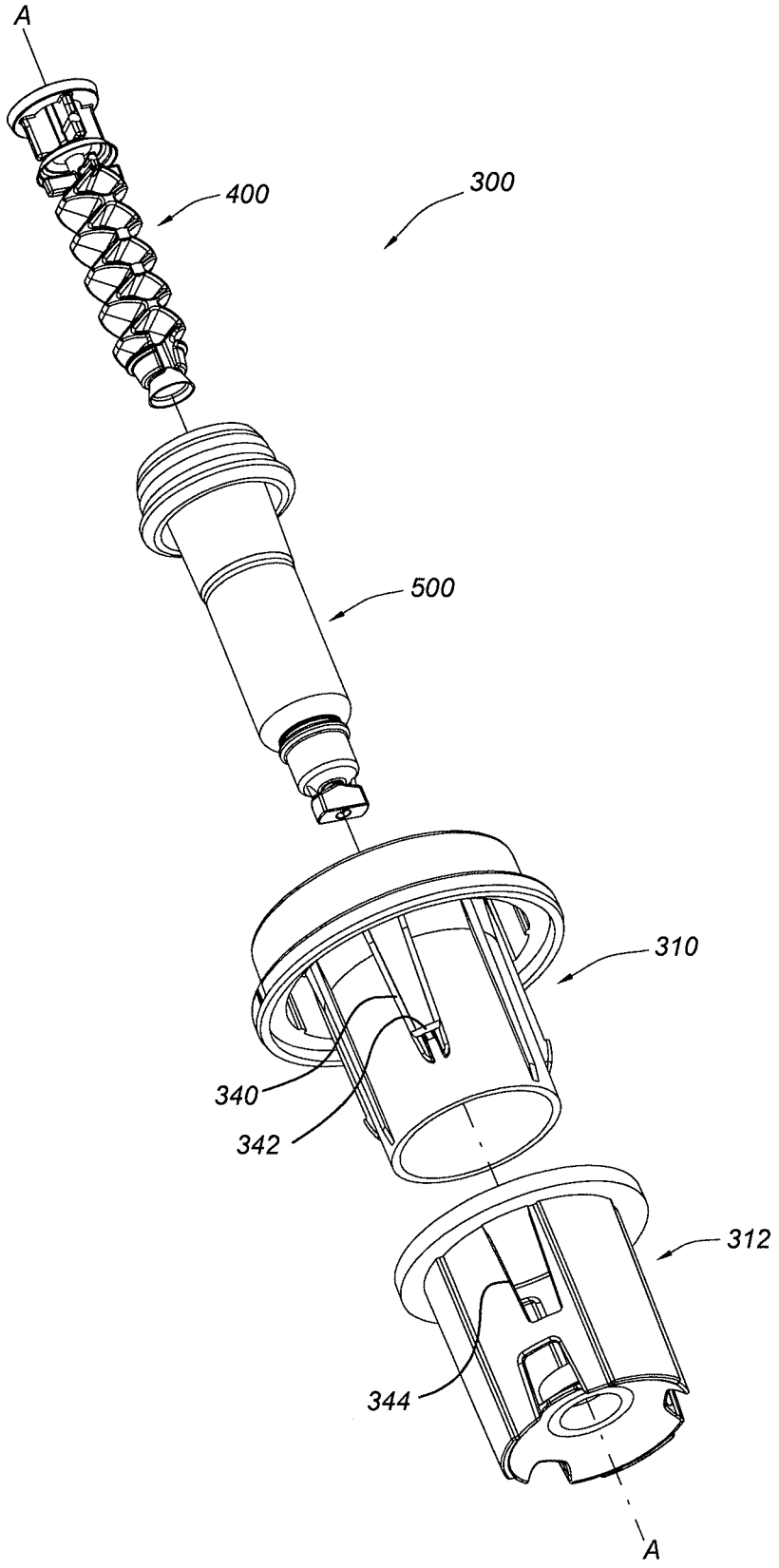
FIG. 5 shows the pump assembly of FIG. 3 in exploded perspective view.

FIG. 5 shows the pump assembly 300 of FIG. 3 in exploded perspective view illustrating the stationary sleeve 310, the sliding sleeve 312, spring 400 and pump body 500 axially aligned along axis A. The stationary sleeve 310 is provided on its outer surface with three axially extending guides 340, each having a detent surface 342. The sliding sleeve 312 is provided with three axially extending slots 344 through its outer surface, the functions of which will be described further below.

Figure 6:
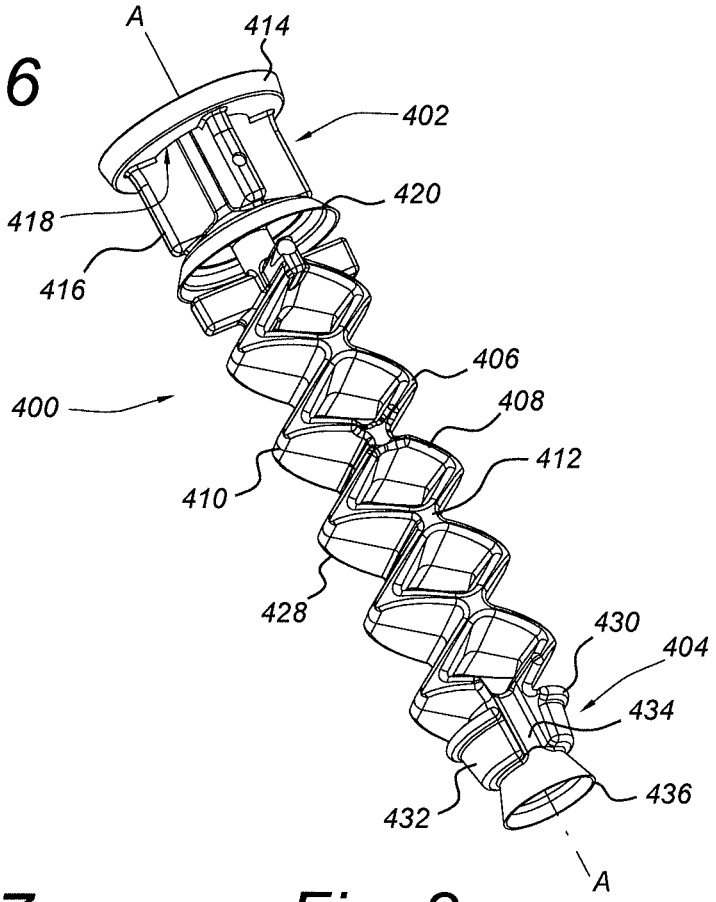
FIG. 6 shows the spring of FIG. 5 in perspective view.

FIG. 6 shows an enlarged perspective view of the spring 400, which is injection moulded in a single piece from ethylene octene material from ExxonMobil Chemical Co. Spring 400 includes a first end portion 402 and a second end portion 404 aligned with each other along the axis A and joined together by a plurality of rhombus shaped spring sections 406. In this embodiment, five spring sections 406 are shown although the skilled person will understand that more or less such sections may be present according to the spring constant required. Each spring section 406 includes four flat leaves 408, joined together along hinge lines 410 that are parallel to each other and perpendicular to the axis A. The leaves 408 have curved edges 428 and the spring sections 406 join at adjacent corners 412.

The first end portion 402 includes a ring element 414 and a cross-shaped support element 416. An opening 418 is formed through the ring element 414. The cross-shaped support element 416 is interrupted intermediate its ends by an integrally formed first valve element 420 that surrounds the first end portion 402 at this point.

The second end portion 404 has a rib 430 and a frusto-conical shaped body 432 that narrows in a direction away from the first end portion 402. On its exterior surface the frusto-conical shaped body 432 is formed with two diametrically opposed flow passages 434. At its extremity it is provided with an integrally formed second valve element 436 projecting conically outwardly and extending away from the first end portion.

FIGS. 7-10 are respective front, side and first and second end elevations of the spring 400.

Figure 7:
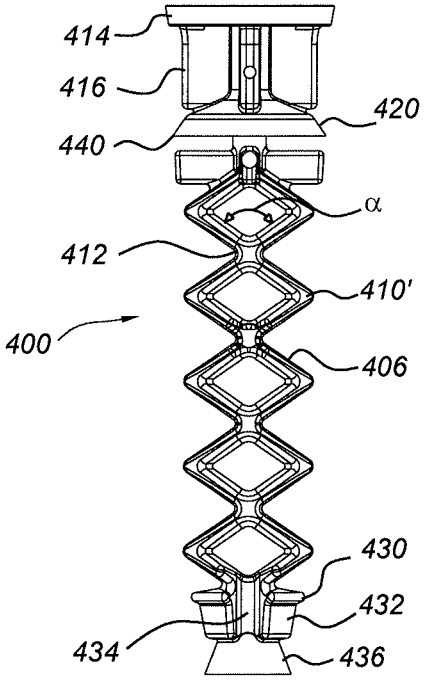
FIG. 7 shows the spring of FIG. 6 in front view.

Starting with FIG. 7, the ring element 414 and cross-shaped support element 416 can be seen, together with the first valve element 420. In this view it may be noted that the first valve element 420 is part spherical in shape and extends to an outer edge 440 that is slightly wider than the cross-shaped support element 416. Also in this view, the rhombus shape of the spring sections 406 can be clearly seen. The spring 400 is depicted in its unstressed condition and the corners 412 define an internal angle $\alpha$ of around 115°. The skilled person will recognise that this angle may be adjusted to modify the spring properties and may vary from 60 to 160 degrees, from 100 to 130 degrees, or between 90 and 120 degrees. Also visible is the frusto-conical shaped body 432 of the second end portion 404 with rib 430, flow passages 434 and second valve element 436.

Figure 8:
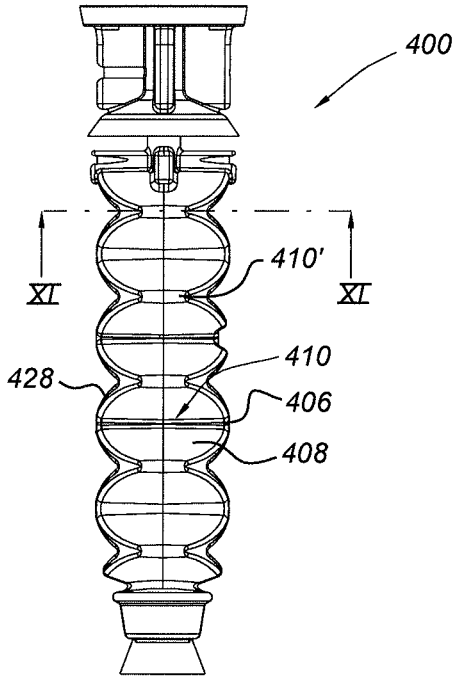
FIG. 8 shows the spring of FIG. 6 in side view.

FIG. 8 depicts the spring 400 in side view, viewed in the plane of the rhombus-shape of the spring sections 406. In this view, the hinge lines 410 can be seen, as can be the curved edges 428. It will be noted that the hinge lines 410' at the corners 412, where adjacent spring sections 406 join, are significantly longer than the hinge lines 410 where adjacent flat leaves 408 join.

Figure 9:
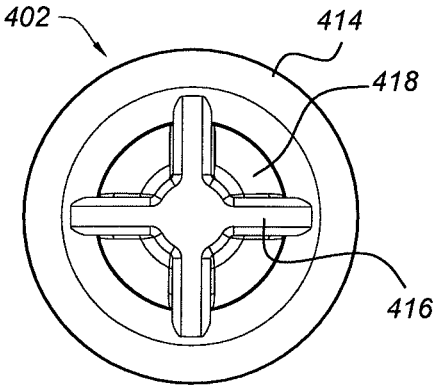
FIG. 9 shows the spring of FIG. 6 in top view.
Figure 10:
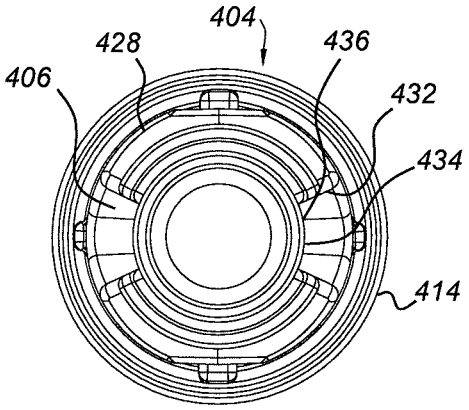
FIG. 10 shows the spring of FIG. 6 in bottom view.

FIG. 9 is a view onto the first end portion 402 showing the ring element 414 with the cross-shaped support element 416 viewed through opening 418. FIG. 10 shows the spring 400 viewed from the opposite end to FIG. 9, with the second valve element 436 at the centre and the frusto-conical shaped body 432 of the second end portion 404 behind it, interrupted by flow passages 434. Behind the second end portion 404, the curved edges 428 of the adjacent spring section 406 can be seen, which in this view define a substantially circular shape. In the shown embodiment, the ring element 414 is the widest portion of the spring 400.

Figure 11:
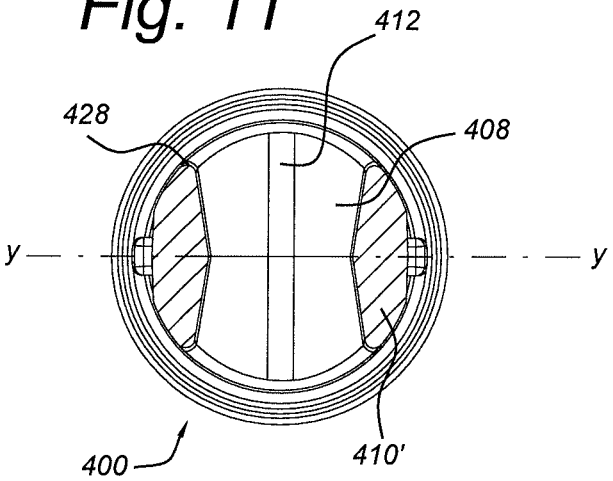
FIG. 11 shows a cross-sectional view through the spring of FIG. 8 along line XI-XI.

FIG. 11, is a cross-sectional view along line XI-XI in FIG. 8 showing the variation in thickness through the flat leaves 408 at the hinge line 410'. As can be seen, each leaf 408 is thickest at its mid-line at location Y-Y and is feathered towards the curved edges 428, which are thinner. This tapering shape concentrates the material strength of the spring towards the mid-line and the force about the mid-line and concentrates the force about the axis A.

Figure 12:
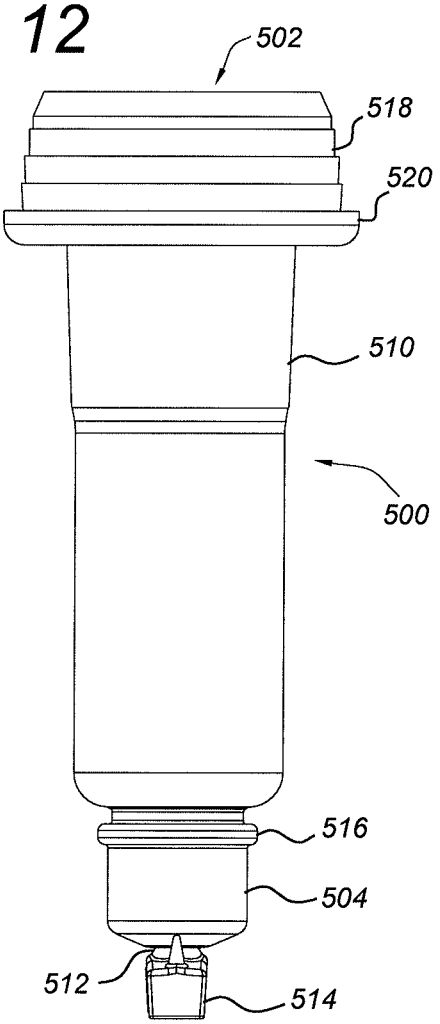
FIG. 12 shows the pump chamber of FIG. 5 in front view.

FIG. 12 shows the pump body 500 of FIG. 5 in front elevation in greater detail. In this embodiment, pump body 500 is also manufactured of the same plastomer material as the spring 400. This is advantageous both in the context of manufacturing and disposal, although the skilled person will understand that different materials may be used for the respective parts. Pump body 500 includes a pump chamber 510, which extends from a pump inlet 502 to a pump outlet 504. The pump outlet 504 is of a smaller diameter than the pump chamber 510 and terminates in a nozzle 512, which is initially closed by a twist-off closure 514. Set back from the nozzle 512 is an annular protrusion 516. The pump inlet 502 includes a boot portion 518 that is rolled over on itself and terminates in a thickened rim 520.

Figure 13:
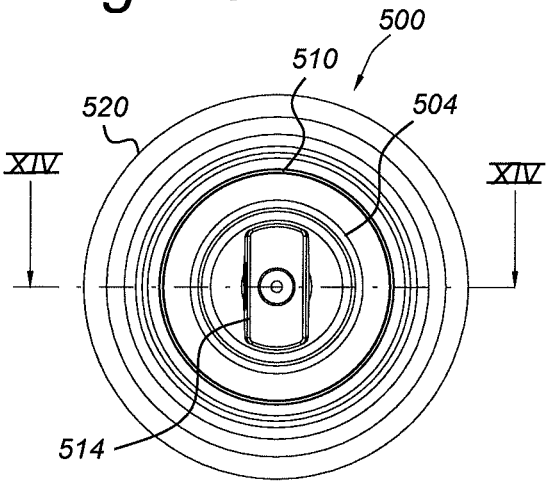
FIG. 13 shows a bottom view of the pump body directed onto the pump outlet.

FIG. 13 shows an end view of the pump body 500 directed onto the pump outlet 504. The pump body 500 is rotationally symmetrical, with the exception of the twist-off closure 514, which is rectangular. The variation in diameter between the pump outlet 504, the pump chamber 510 and the thickened rim 520 can be seen.

Figure 14:
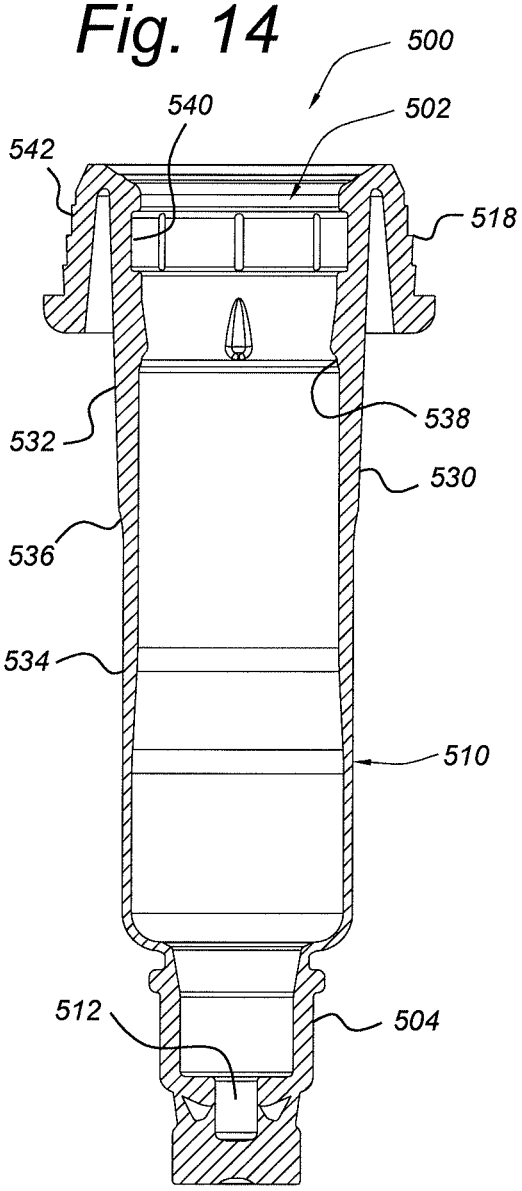
FIG. 14 is a longitudinal cross-sectional view of the pump body taken in direction XIV-XIV in FIG. 13.

FIG. 14 is a longitudinal cross-sectional view of the pump body 500 taken in direction XIV-XIV in FIG. 13. The pump chamber 510 includes a flexible wall 530, having a thick-walled section 532 adjacent to the pump inlet 502 and a thin-walled section 534 adjacent to the pump outlet 504. The thin-walled section 534 and the thick-walled section 532 join at a transition 536. The thin-walled section 534 tapers in thickness from the transition 536 with a decreasing wall thickness towards the pump outlet 504. The thick-walled section 532 tapers in thickness from the transition 536 with an increasing wall thickness towards the pump inlet 502. The thick-walled section 532 also includes an inlet valve seat 538 at which the internal diameter of the pump chamber 510 reduces as it transitions to the pump inlet 502. In addition to the variations in wall thickness of the pump chamber 510, there is also provided an annular groove 540 within the pump body 500 at the pump inlet 502 and sealing ridges 542 on an exterior surface of the boot portion 518.

Figure 15:
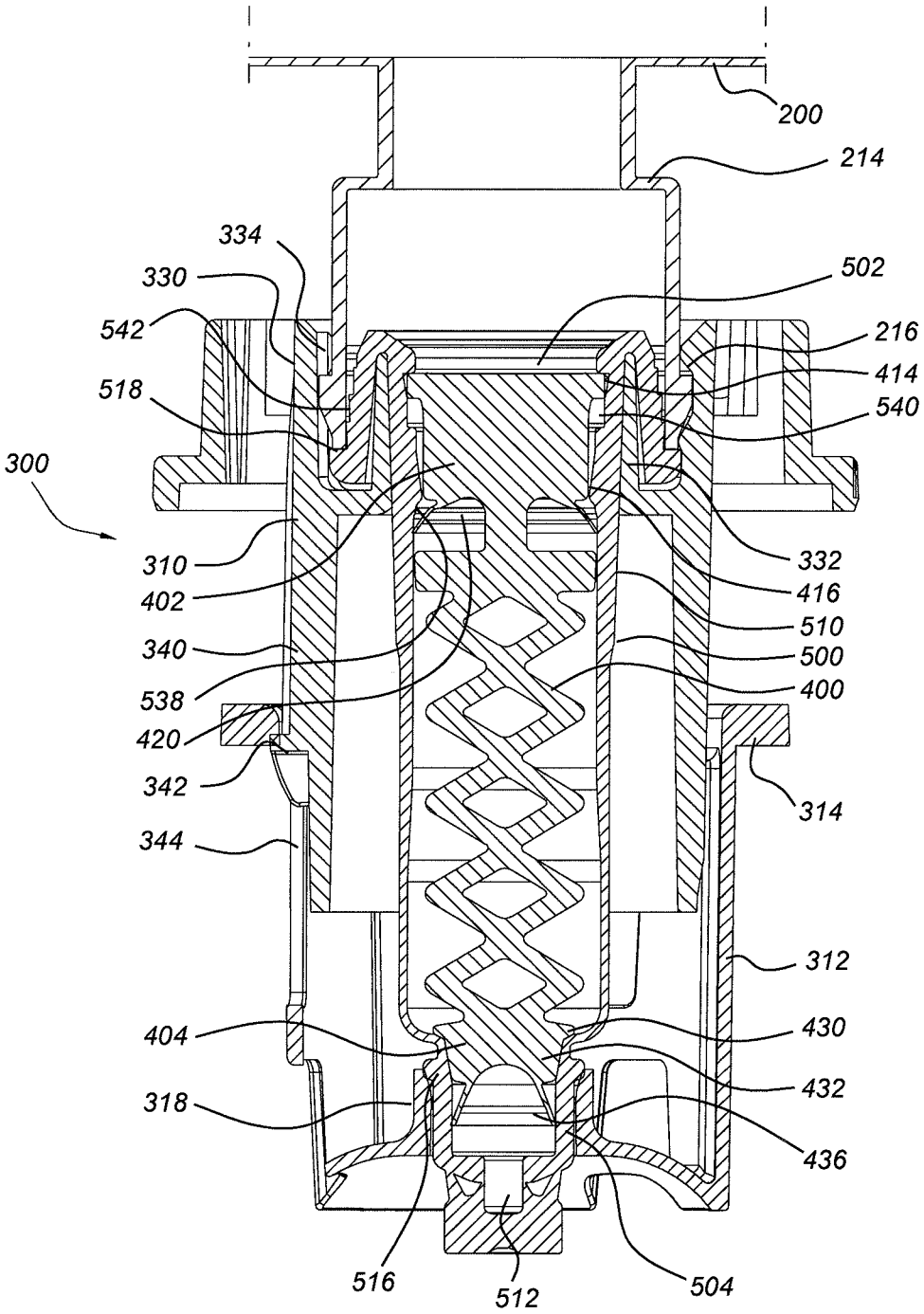
FIGS. 15-18 are cross-sectional views through the pump assembly of FIG. 3 in various stages of operation.

FIG. 15 is a cross-sectional view through the pump assembly 300 of FIG. 3, showing the spring 400, the pump body 500 and the sleeves 310, 312, connected together in a position prior to use. Stationary sleeve 310 includes a socket 330 opening towards its upper side. The socket 330 has an upwardly extending male portion 332 sized to engage within the boot portion 518 of the pump body 500. The socket 330 also includes inwardly directed cams 334 on its inner surface of a size to engage with the connecting flange 216 on the rigid neck 214 of container 200 in a snap connection. The engagement of these three portions results in a fluid tight seal, due to the flexible nature of the material of the pump body 500 being gripped between the relatively more rigid material of the connecting flange 216 and the stationary sleeve 310. Additionally, the sealing ridges 542 on the exterior surface of the boot portion 518 engage within the rigid neck 214 in the manner of a stopper. In the depicted embodiment, this connection is a permanent connection but it will be understood that other e.g. releasable connections may be provided between the pump assembly 300 and the container 200.

FIG. 15 also depicts the engagement between the spring 400 and the pump body 500. The inlet portion 402 of the spring 400 is sized to fit within the pump inlet 502 with the ring element 414 engaged in the groove 540 and the cross-shaped support element 416 engaging against the interior surface of the pump inlet 502 and the adjacent pump chamber 510. The first valve element 420 rests against the inlet valve seat 538 with a slight pre-load, sufficient to maintain a fluid-tight seal in the absence of any external pressure.

At the other end of the pump body 500, the outlet portion 404 engages within the pump outlet 504. The rib 430 has a greater diameter than the pump outlet 504 and serves to position the frusto-conical shaped body 432 and the second valve element 436 within the pump outlet 504. The outside of the pump outlet 504 also engages within the orifice 318 of the sliding sleeve 312 with the nozzle 512 slightly protruding. The annular protrusion 516 is sized to be slightly larger than the orifice 318 and maintains the pump outlet 504 at the correct position within the orifice 318. The second valve element 436 has an outer diameter that is slightly larger than the inner diameter of the pump outlet 504, whereby a slight pre-load is also applied, sufficient to maintain a fluid-tight seal in the absence of any external pressure.

FIG. 15 also shows how the sleeves 310, 312 engage together in operation. The sliding sleeve 312 is slightly larger in diameter than the stationary sleeve 310 and encircles it. The three axial guides 340 on the outer surface of the stationary sleeve 310 engage within respective slots 344 in the sliding sleeve. In the position shown in FIG. 15, the spring 400 is in its initial condition being subject to a slight pre-compression and the detent surfaces 342 engage against the actuating flange 314.

In the position shown in FIG. 15, the container 200 and pump assembly 300 are permanently connected together and are supplied and disposed of as a single disposable unit. The snap connection between socket 330 and the connecting flange 216 on the container 200 prevents the stationary sleeve 310 from being separated from the container 200. The detent surfaces 342 prevent the sliding sleeve 312 from being removed from its position around the stationary sleeve 310 and the pump body 500 and spring 400 are retained within the sleeves 310, 312.

Figure 16:
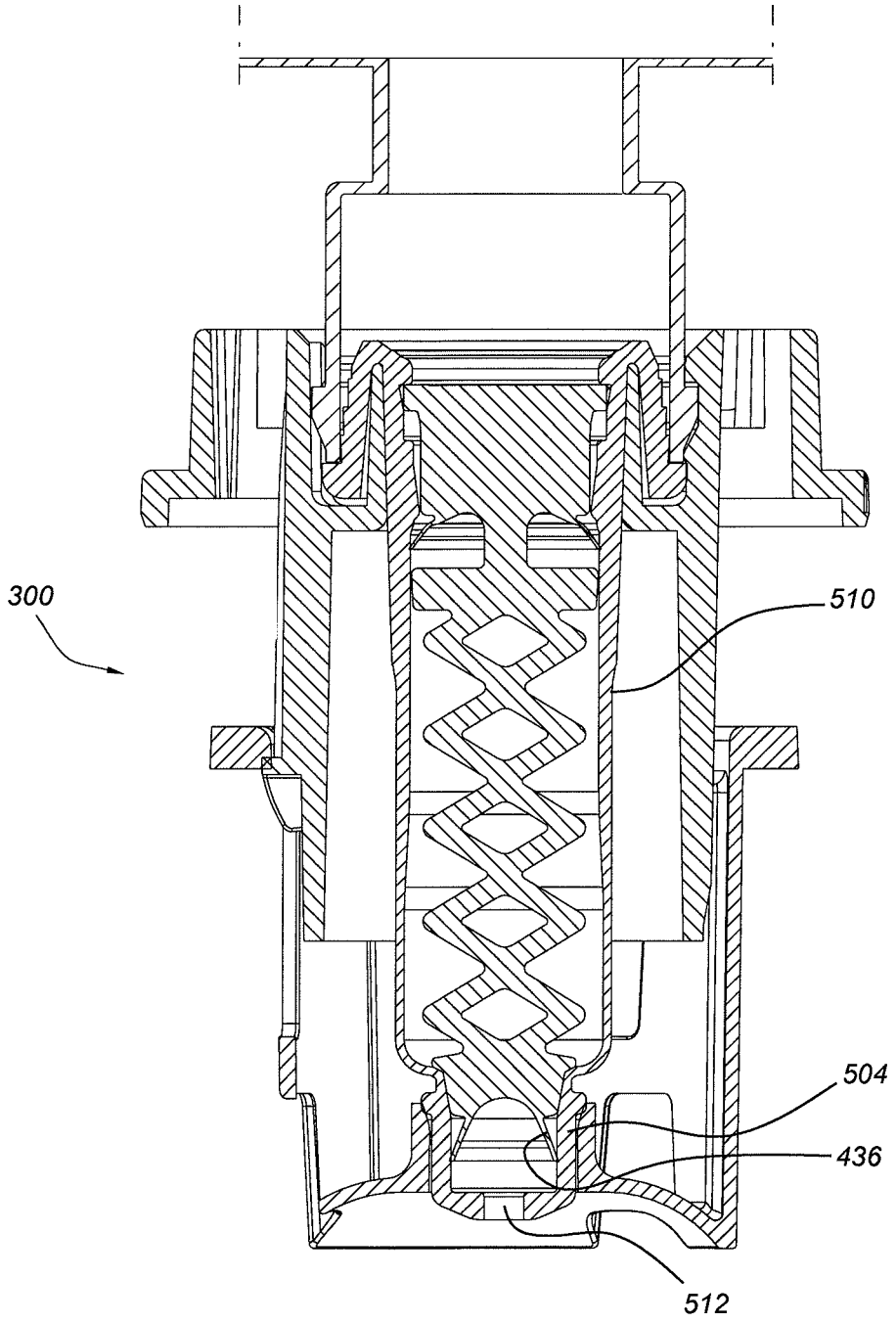

FIG. 16 shows a similar view to FIG. 15 with the twist-off closure 514 removed. The pump assembly 300 is now ready for use and may be installed into a dispenser 100 as shown in FIG. 2. For the sake of the following description, the pump chamber 510 is full of fluid to be dispensed although it will be understood that on first opening of the twist-off closure 514, the pump chamber 510 may be full of air. In this condition, the second valve element 436 seals against the inner diameter of the pump outlet 504, preventing any fluid from exiting through the nozzle 512.

Figure 17:
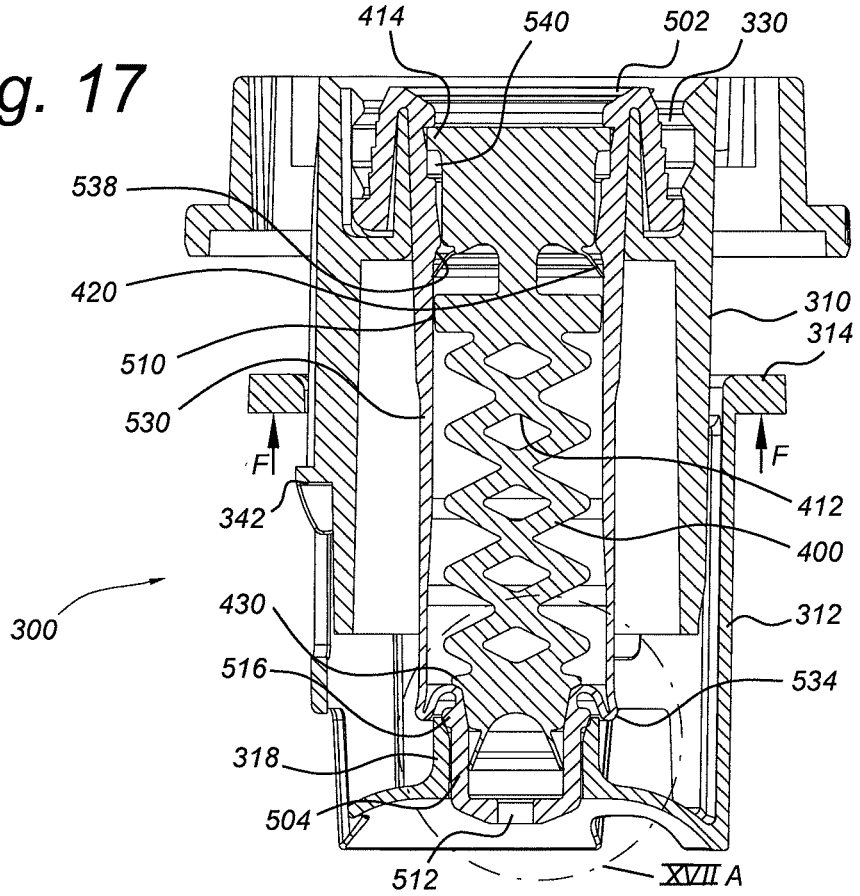

FIG. 17 shows the pump assembly 300 of FIG. 16 as actuation of a dispensing stroke is commenced, corresponding to the action described in relation to FIGS. 4A and 4B. As previously described in relation to those figures, engagement of actuator 124 by a user causes the engagement portion 134 to act against the actuating flange 314 exerting a force F. In this view, the container 200 has been omitted for the sake of clarity.

The force F causes the actuating flange 314 to move out of engagement with the detent surfaces 342 and the sliding sleeve 312 to move upwards with respect to the stationary sleeve 310. This force is also transmitted by the orifice 318 and the annular protrusion 516 to the pump outlet 504, causing this to move upwards together with the sliding sleeve 312. The other end of the pump body 400 is prevented from moving upwards by engagement of the pump inlet 502 with the socket 330 of the stationary sleeve 310.

The movement of the sliding sleeve 312 with respect to the stationary sleeve 310 causes an axial force to be applied to the pump body 400. This force is transmitted through the flexible wall 530 of the pump chamber 510, which initially starts to collapse at its weakest point, namely the thin walled section 534 adjacent to the pump outlet 504. As the pump chamber 510 collapses, its volume is reduced and fluid is ejected through the nozzle 512. Reverse flow of fluid through the pump inlet 502 is prevented by the first valve element 420, which is pressed against the inlet valve seat 538 by the additional fluid pressure within the pump chamber 510.

Additionally, the force is transmitted through the spring 400 by virtue of the engagement between the rib 430 and the pump outlet 504 and the ring element 414 being engaged in the groove 540 at the pump inlet 502. This causes the spring 400 to compress, whereby the internal angle $\alpha$ at the corners 412 increases.

Figure 17A:
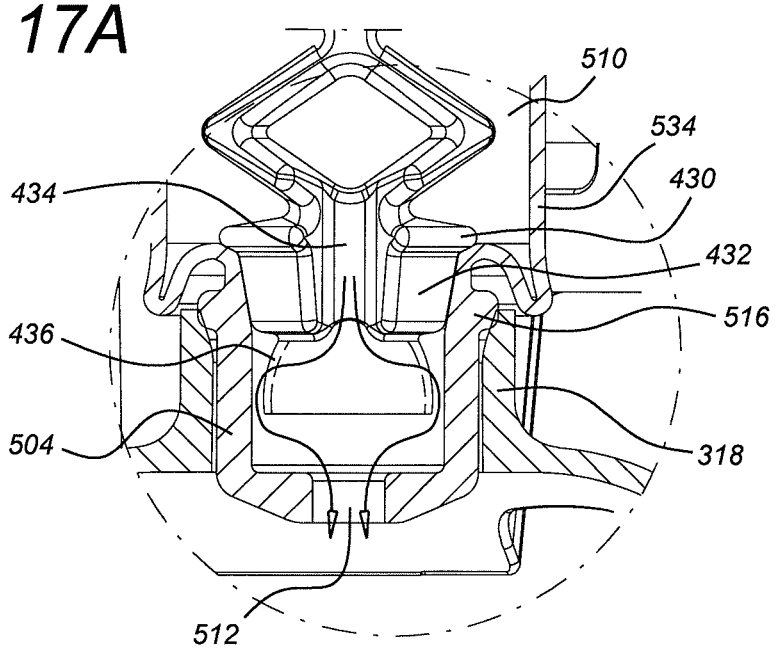
FIG. 17A is a detail in perspective of the pump outlet of FIG. 17.

FIG. 17A is a detail in perspective of the pump outlet 504 of FIG. 17, showing in greater detail how second valve element 436 operates. In this view, spring 400 is shown unsectioned. As can be seen, thin walled section 534 has collapsed by partially inverting on itself adjacent to the annular protrusion 516. Below the annular protrusion 516, the pump outlet 504 has a relatively thicker wall and is supported within the orifice 318, maintaining its form and preventing distortion or collapse. As can also be seen in this view, rib 430 is interrupted at flow passage 434, which extends along the outer surface of the frusto-conical shaped body 432 to the second valve element 436. This flow passage 434 allows fluid to pass from the pump chamber 510 to engage with the second valve element 436 and exert a pressure onto it. The pressure causes the material of the second valve element 436 to flex away from engagement with the inner wall of the pump outlet 504, whereby fluid can pass the second valve element 436 and reach the nozzle 512. The precise manner in which the second valve element 436 collapses, will depend upon the degree and speed of application of the force F and other factors such as the nature of the fluid, the pre-load on the second valve element 436 and its material and dimensions. These may be optimised as required.

Figure 18:
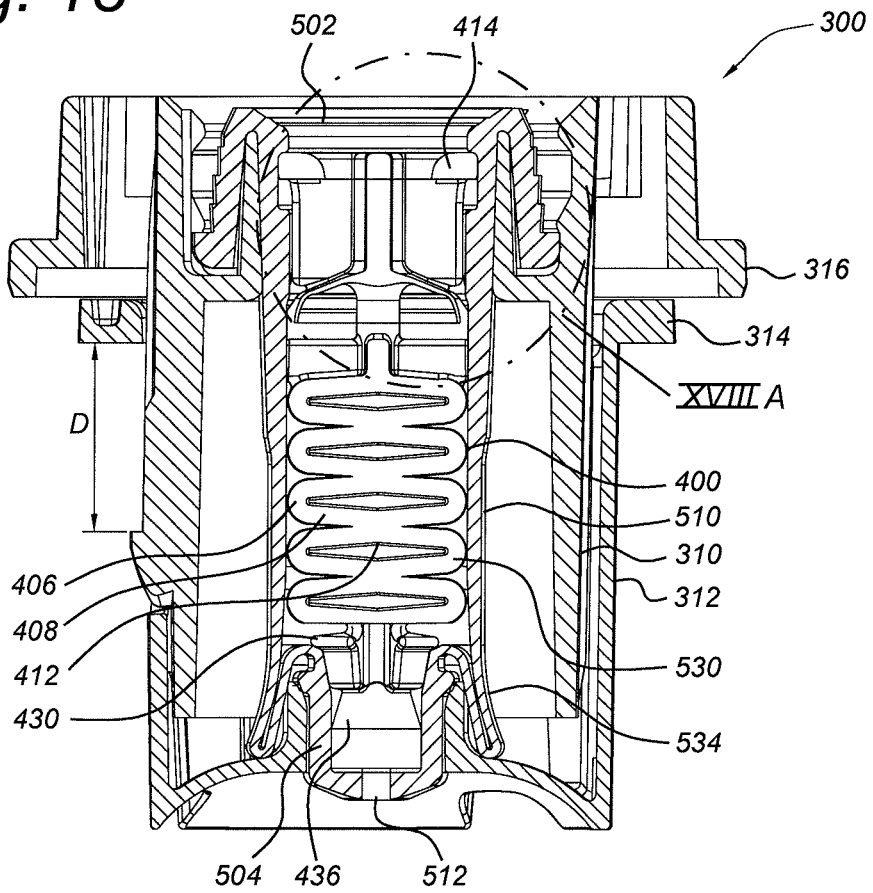

FIG. 18 shows the pump assembly 300 of FIG. 17 in fully compressed state on completion of an actuation stroke. The sliding sleeve 312 has moved upwards a distance D with respect to the initial position of FIG. 16 and the actuating flange 314 has entered into abutment with the locating flange 316. In this position, pump chamber 310 has collapsed to its maximum extent whereby the thin walled section 534 has fully inverted. The spring 400 has also collapsed to its maximum extent with all of the rhombus-shaped spring section 406 fully collapsed to a substantially flat configuration in which the leaves 408 lie close against each other and, in fact all of the leaves 408 are almost parallel to each other. It will be noted that although reference is given to fully compressed and collapsed conditions, this need not be the case and operation of the pump assembly 300 may take place over just a portion of the full range of movement of the respective components.

As a result of the spring sections 406 collapsing, the internal angle $\alpha$ at the corners 412 approaches 180° and the overall diameter of the spring 400 at this point increases. As illustrated in FIG. 18, the spring 400, which was initially slightly spaced from the flexible wall 530, engages into contact with the pump chamber. At least in the region of the thin walled section 534, the spring sections 406 exert a force on the flexible wall 530, causing it to stretch.

Once the pump has reached the position of FIG. 18, no further compression of the spring 400 takes place and fluid ceases to flow through the nozzle 512. The second valve element 436 closes again into sealing engagement with the pump outlet 504. In the illustrated embodiment, the stroke, defined by distance D is around 14 mm and the volume of fluid dispensed is about 1.1 ml. It will be understood that these distances and volumes can be adjusted according to requirements.

After the user releases the actuator 124 or the force F is otherwise discontinued, the compressed spring 400 will exert a net restoring force on the pump body 500. The spring depicted in the present embodiment exerts an axial force of 20N in its fully compressed condition. This force, acts between the ring element 414 and the rib 430 and exerts a restoring force between the pump inlet 502 and the pump outlet 504 to cause the pump chamber 510 to revert to its original condition. The pump body 500 by its engagement with the sleeves 310, 312 also causes these elements to return towards their initial position as shown in FIG. 16.

As the spring 400 expands, the pump chamber 510 also increases in volume leading to an under pressure within the fluid contained within the pump chamber 510. The second valve element 436 is closed and any under pressure causes the second valve element 436 to engage more securely against the inner surface of the pump outlet 504.

Figure 18A:
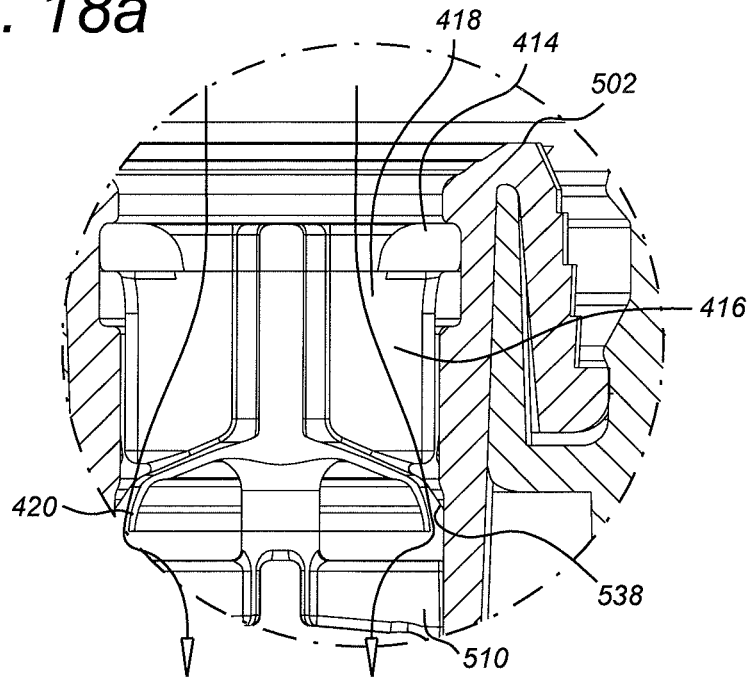
FIG. 18A is a detail in perspective of the pump inlet of FIG. 18.

FIG. 18A shows a perspective detail of part of the pump inlet 502 of FIG. 18. At the pump inlet 502, the first valve element 420 can flex away from the inlet valve seat 538 due to the lower pressure in the pump chamber 510 compared to that in the container 200. This causes fluid to flow into the pump chamber 510 through the rigid neck 214 of the container 200 and the opening 418 formed through the ring element 414 and over the cross-shaped support element 416.

As the skilled person appreciates, the spring may provide a major restoring force during the return stroke. However, as the spring 400 extends, its force may also be partially augmented by radial pressure acting on it from the flexible wall 530 of the pump chamber 510. The pump chamber 510 may also exert its own restoring force on the sliding sleeve 312 due to the inversion of the thin walled section 534, which attempts to revert to its original shape. Neither the restoring force of the spring 400 nor that of the pump chamber 510 is linear but the two may be adapted together to provide a desirable spring characteristic. In particular, the pump chamber 510 may exert a relatively strong restoring force at the position depicted in FIG. 17, at which the flexible wall 530 just starts to invert. The spring 400 may exert its maximum restoring force when it is fully compressed in the position according to FIG. 18.

The spring 400 of FIGS. 6 to 11 and pump body 500 of FIGS. 12 to 14 are dimensioned for pumping a volume of around 1-2 ml, e.g. around 1.1 ml. In a pump dimensioned for 1.1 ml, the flat leaves 408 have a length of around 7 mm, measured as the distance between hinge lines 410 about which they flex. They have a thickness at their mid-lines of around 1 mm. The overall length of the spring is around 58 mm. The pump body 400 has an overall length of around 70 mm, with the pump chamber 510 comprising around 40 mm and having an internal diameter of around 15 mm and a minimal wall thickness of around 0.5 mm. The skilled person will understand that these dimensions are exemplary.

The pump/spring may develop a maximum resistance of between 1 N and 50 N, more specifically between 20 N and 25 N on compression. Furthermore, the pump/spring bias on the reverse stroke for an empty pump may be between 1 N and 50 N, between 1 N and 30 N, between 5 N and 20 N, or between 10 N and 15 N. In general, the compression and bias forces may depend on and be proportional to the intended volume of the pump. The values given above may be appropriate for a 1 ml pump stroke.

Thus, the present disclosure has been described by reference to the embodiments discussed above. It will be recognized that these embodiments are susceptible to various modifications and alternative forms well known to those of skill in the art without departing from the spirit and scope of the invention as defined by the appended claims.

The invention claimed is:

1. A fluid pump comprising:

a plastomer spring, the spring comprising a first end portion and a second end portion and a plurality of spring sections, joined together in series at adjacent corners and aligned with each other in an axial direction to connect the first end portion to the second end portion, which spring sections can be compressed in the axial direction from an initial condition to a compressed condition and can subsequently expand to their initial condition; and a pump body having an elongate pump chamber surrounding the spring and extending from a pump inlet adjacent to the first end portion to a pump outlet adjacent to the second end portion, wherein the pump chamber is compressible together with the spring in the axial direction and comprises a flexible wall that inverts during compression of the pump chamber.

2. The pump according to claim 1, wherein each spring section comprises four flat leaves joined together along hinge lines that are parallel to each other and perpendicular to the axial direction.

3. The pump according to claim 2, wherein the leaves are feathered from a relatively thicker mid-line to relatively thinner edges.

4. The pump according to claim 1, wherein the spring sections have curved edges such that the spring has a generally circular configuration, as viewed in the axial direction.

5. The pump according to claim 1, wherein, in their initial condition, the spring sections join at adjacent corners having an internal angle of between 60 to 160 degrees.

6. The pump according to claim 1, wherein the spring sections are arranged to compress from an open configuration to a substantially flat configuration.

7. The pump according to claim 1, wherein each spring section can compress axially to less than 60% of its uncompressed length.

8. The pump according to claim 1, comprising at least three spring sections.

9. The pump according to claim 1, wherein the spring comprises a material having a flexural modulus according to ASTM D-790 in the range of 15-80 MPa.

10. The pump according to claim 1, wherein the spring comprises a material having an ultimate tensile strength according to ASTM D-638 in the range of 3-11 MPa.

11. The pump according to claim 1, wherein the spring comprises a material having a melt flow index according to ISO standard 1133-1 of at least 10 dg/min.

12. The pump according to claim 1, wherein the spring comprises an ethylene alpha olefin copolymer.

13. The pump according to claim 1, wherein the spring further comprises an integrally formed first valve element.

14. The pump according to claim 13, wherein the first valve element is formed as a circumferential element projecting outwardly.

15. The pump according to claim 13, wherein the spring further comprises an integrally formed second valve element formed as a circumferential element projecting outwardly.

16. The pump according to claim 1, wherein the first and second end portions engage with the pump inlet and pump outlet respectively, to retain such engagement during compression of the pump chamber.

17. The pump according to claim 1, wherein the pump body and the spring are injection molded of the same material.

18. The pump according to claim 1, wherein the pump body and the spring are injection molded of different materials.

19. The pump according to claim 1, consisting of only two components, namely the pump body and the spring, whereby the pump body and the spring interact to define a one-way inlet valve and a one-way outlet valve.

20. A pump assembly comprising:

the pump according to claim 1; and a pair of sleeves, arranged to slidably interact to guide the pump during a pumping stroke, including a stationary sleeve engaged with the pump inlet and a sliding sleeve engaged with the pump outlet.

21. A disposable fluid dispensing package, comprising the pump according to claim 1 sealingly connected to a collapsible product container.

22. A method of dispensing a fluid from the pump according to claim 1, the method comprising exerting an axial force on the pump body between the pump inlet and the pump outlet to cause axial compression of the spring and a reduction in volume of the pump chamber.

* * * * *